US007147732B2

(12) United States Patent
Stratton

(10) Patent No.: US 7,147,732 B2
(45) Date of Patent: Dec. 12, 2006

(54) QUENCHING METHOD AND APPARATUS

(75) Inventor: Paul Stratton, Huddersfield (GB)

(73) Assignee: The BOC Group plc, Windlesham (GB)

( * ) Notice: Subject to any disclaimer, the term of this patent is extended or adjusted under 35 U.S.C. 154(b) by 280 days.

(21) Appl. No.: 10/433,272

(22) PCT Filed: Nov. 30, 2001

(86) PCT No.: PCT/GB01/05308

§ 371 (c)(1),
(2), (4) Date: Oct. 14, 2003

(87) PCT Pub. No.: WO02/44430

PCT Pub. Date: Jun. 6, 2002

(65) Prior Publication Data

US 2004/0050465 A1 Mar. 18, 2004

(30) Foreign Application Priority Data

Nov. 30, 2000 (GB) ..... 0029281.3

(51) Int. Cl.
*C21D 1/62* (2006.01)

(52) U.S. Cl. ..... 148/709; 148/712

(58) Field of Classification Search ..... 148/709, 148/712

See application file for complete search history.

(56) References Cited

U.S. PATENT DOCUMENTS 3,937,276 A * 2/1976 Ostwald ..... 165/135
4,249,964 A * 2/1981 Bambuch et al. ..... 148/217
5,770,146 A 6/1998 Ebner

FOREIGN PATENT DOCUMENTS

| | | | |
|---|---|---|---|
| DE | 4208485 C1 | | 2/1993 |
| DE | 19853221 A1 | | 5/2000 |
| EP | 0911418 A1 | | 4/1999 |
| GB | 1394197 | | 5/1975 |
| JP | 05-179364 | * | 7/1993 |
| JP | 050179364 A | | 7/1993 |
| WO | WO 89-12111 | | 12/1989 |

OTHER PUBLICATIONS

T. Lubben et al., The Uniformity of Cooling in High-Pressure Gas Quenching, 2000, Heat Treatment of Metals, 2000.3, p. 57-61.*
T. Lubben et al, Scattering of Heat Transfer Coefficient in High Pressure Gas Quenching, 18th ASM Heat Treating Society Conference in Rosemont, Illinois, USA on Oct. 12-15, 1998, 1-7.*
P F Stratton et al., Modelling of high speed gas quenching, Mar. 2000, Journal of Shanghai Jiaotong University, vol. E-5, No. 1, 2000, 146-155.*
Davis et al., ASM Handbook, 1995, ASM International, vol. 4, 312-318.*
Intern'l Search Report, Apr. 17, 2002, Stratton.
GB Search Report, Jun. 15, 2001, Lawson.
"Innovations in Quenching Systems and Equipment: Current Status and Feature Developments" by F. T. Hoffmann et al, Heat Treatment of Metals, 1999.3, pp. 63-67.

* cited by examiner

*Primary Examiner*—Roy King
*Assistant Examiner*—Michael P. Alexander
(74) *Attorney, Agent, or Firm*—Bernard Lau; Ira Zebrak

(57) ABSTRACT

A hot object is quenched after heat treatment. A hot gas stream having at least 20% by volume of hydrogen is taken from for example a carburising chamber of a furnace. The gas is cooled by passage through a heat exchanger, and is compressed in a compressor. The compressor has an after-cooler (not shown) to remove heat of compression from the gas. The cooled, compressed gas flows through nozzles into a quenching chamber. The gas leaves the nozzles at a velocity of at least 50 m/s and impinges upon the hot metal object so as to effect its quenching.

14 Claims, 1 Drawing Sheet

QUENCHING METHOD AND APPARATUS

BACKGROUND OF THE INVENTION

This invention relates to a method of and apparatus for quenching a hot metal object.

It is very well known in the art of heat treating metal that quenching a metallic object (that is, rapidly cooling the object from a heat treatment temperature, typically at least 850° C., to a much lower, usually room, temperature) can significantly improve its mechanical properties and characteristics. For example, quenching can be used to harden the object and/or to improve its mechanical properties, by controlling internal crystallisation or precipitation, or both. Traditionally, quenching has been carried out using liquid such as water, oil or brine, either in the form of an immersion bath or a spraying medium. In more recent years, gas quenching methods have been developed. Gas quenching has the advantage of not usually requiring an after quenching step to clean or wash the quenched metal object. Another advantage of gas quenching is that if an oil or water-based fluid is used non-uniformity problems can arise as a result of Leidenfrost's phenomenon, whereas in gas quenching, this problem is believed not to arise.

The main drawback of the gas quenching which, has to now been limited in its commercial use, is a difficulty in achieving a quench rate comparable to those that characterise liquid-based cooling methods. Gas quenching is discussed in "Innovations in Quenching Systems and Equipment: Current Status and Feature Developments", by F T Hoffmann et al, Heat Treatment of Metals, 1999, 3, pp 63 to 67. Hoffmann et al dedoes not however disclose how to form a hydrogen quenching atmosphere.

Gas quenching is also disclosed in EP-A-0 911 418 and in U.S. Pat. No. 5,770,146. GB-A-1 394 197 describes the operation of a furnace for annealing coiled steel strip. The furnace has a series of five cooling sections which employ recycled gas from the annealing section. The recycled gas is coded and supplied to the cooling sections by means of jet nozzles. A ROOTS-type blower may be used to recirculate the gas from the annealing section to the nozzles. Cooling rates of up to 25° C. per hour are achieved. Such cooling rates are to be contrasted with the high cooling rates of at least 50° C. per hour that characterise gas quenching.

SUMMARY OF THE INVENTION

According to the present invention there is provided a method of quenching a hot metal object by taking a hot gas stream comprising at least 20% by volume of hydrogen from a source thereof, cooling the hot gas stream, compressing the cooled gas stream, removing heat of compression from the cool pressed gas stream, passing the compressed gas through at least one nozzle and causing the gas issuing from the said nozzle to impinge upon the hot metal object so as to quench the object, wherein the source of the hot gas is a heat treatment chamber from which the hot metal object is taken for quenching or a gas generator which supplies hot gas to the heat treatment chamber.

The invention also provides apparatus for quenching a hot metal object taken from a heat treatment chamber, comprising a source of hot gas containing at least 20% by volume of hydrogen, a heat exchanger for cooling the hot gas having an inlet communicating with the source and an outlet communicating with an inlet to a compressor, an aftercooler associated with the compressor, a quenching chamber, means for introducing the hot metal object into the quenching chamber, at least one nozzle arranged so as to cause, in use, gas to impinge upon the object to be quenched in the quenching chamber, the said nozzle communicating with an outlet from the compressor, wherein the source of the hot gas is the heat treatment chamber or a gas generator which is able to supply hot gas containing at least 20% by volume of hydrogen to the heat treatment chamber.

By employing the heat treatment chamber or gas generator as the source of the quenching gas, the need for a separate supply of hydrogen to the quenching step is obviated.

Although the method and apparatus according to the present invention may be employed in annealing the metal object, they are particularly suitable if the metal object is to be hardened, carburised, case hardened or carbonitrited and are able to treat effectively metal objects of complex shops.

The hot gas is typically taken from the heat treatment chamber or the generator at a temperature in the range of 850° C. to 950° C. If the heat treatment for example, comprises carburising the metal object, the hot gas preferably contains from 25 to 40% by volume of hydrogen. The hot gas may in addition contain from 40 to 60% by volume of nitrogen, from 12 to 20% by volume of carbon monoxide, with smaller amounts of other gases such as methane, water vapour, and carbon dioxide typically also being present. If the heat treatment comprises carbonitriding or austenitic nitrocarburising the metal objects the atmosphere may also include ammonia.

The stream of hot gas is preferably compressed to a pressure up to 10 bar gauge, the maximum pressure not being so great that the dew point of the gas is less than 15° C., thus ensures that water does not precipitate out of the gas stream.

A carburising gas stream may be formed in an endothermic generator or, preferably, by supplying nitrogen and a precursor of both carbon monoxide and hydrogen to the carburising chamber and permitting the precursor to decompose in the carburising chamber to form carbon monoxide and hydrogen. The preferred precursor is methanol. One advantage of forming the carburising gas in such a way rather than in an endothermic generator is that it enables the composition of the atmosphere to be adjusted by adjusting the flow rates of the nitrogen and the precursor. For example, if the precursor is methanol, its flow rate can be selected so as to give the minimum water content in the resulting gaseous atmosphere in the carburising chamber, and thereby maximising the pressure to which the gas stream withdrawn from the carburising chamber can be compressed. Preferably, the atmosphere is formed by supplying to the carburising chamber 55 volumes of nitrogen to every 45 volumes of methanol.

The heat treatment chamber is preferably operated at a pressure in the range of 0 bar gauge to 1 bar gauge.

The hot gas stream taken from the heat treatment chamber is preferably cooled by indirect heat exchange with a stream of nitrogen. If the nitrogen is to be supplied to the treatment chamber, this has the added advantage of preheating the nitrogen. The cooled gas stream preferably leaves the heat exchanger at a temperature less than 50° C.

Preferably, a gas storage vessel is located intermediate the compressor outlet and the said nozzle. Such an arrangement keeps down the power consumption of the method and apparatus according to the invention when the quenching is performed intermittently.

Typically, depending on the size of the object to be cooled, a plurality of nozzles is used in the method and apparatus according to the invention. Preferably, the distance between each nozzle outlet and the surface at which the gas issuing from the nozzle is directed is less than or equal to the diameter of the nozzle. Such a distance is selected in view of our discovery that at small values of the distance between the nozzle outlet and the surface of the object there is a surprisingly large increase in the heat transfer rate as the distance decreases.

Preferably the distance between adjacent nozzle outlets is in the range of from 2 to 8 times the diameter of each nozzle.

Preferably the or each nozzle directs gas so as to impinge substantially perpendicularly on the surface of the object.

Because the rate of cooling during quenching is directly related to the velocity of the gas streams, and the velocity to the gas supply pressure, it is a relatively simple matter to control the cooling rate. The preferred gas velocities are at least 50 meters per second, more preferably in the range of 50 to 100 meters per second. Typical nozzle diameters are in the range of 3.2 to 6.4 mm.

Preferably, there is a conduit having one end terminating in the quenching chamber and another end terminating in the heat treatment chamber. This allows spent gas from the quenching chamber to flow to the heat treatment chamber. The conduit also enables reducing gas to be supplied to the quenching chamber when quenching is not taking place provided that the pressure in the heat treatment chamber is maintained slightly above that in the quenching chamber when the latter is idle.

The heat treatment chamber and the quenching chamber may form part of the same furnace, for example a roller hearth furnace. If the furnace has a cooling chamber intermediate the heat treatment chamber and the quenching chamber, the reducing gas may be withdrawn from the cooling chamber. This, however, is not preferred as the dew point of the atmosphere is greater in the cooling chamber.

BRIEF DESCRIPTION OF THE DRAWINGS

The method according to the invention will now be described by way of example with reference to the accompanying drawing which is a schematic flow diagram of a roller hearth furnace which has been adapted to perform the invention.

DETAILED DESCRIPTION OF THE INVENTION

Figure 1:
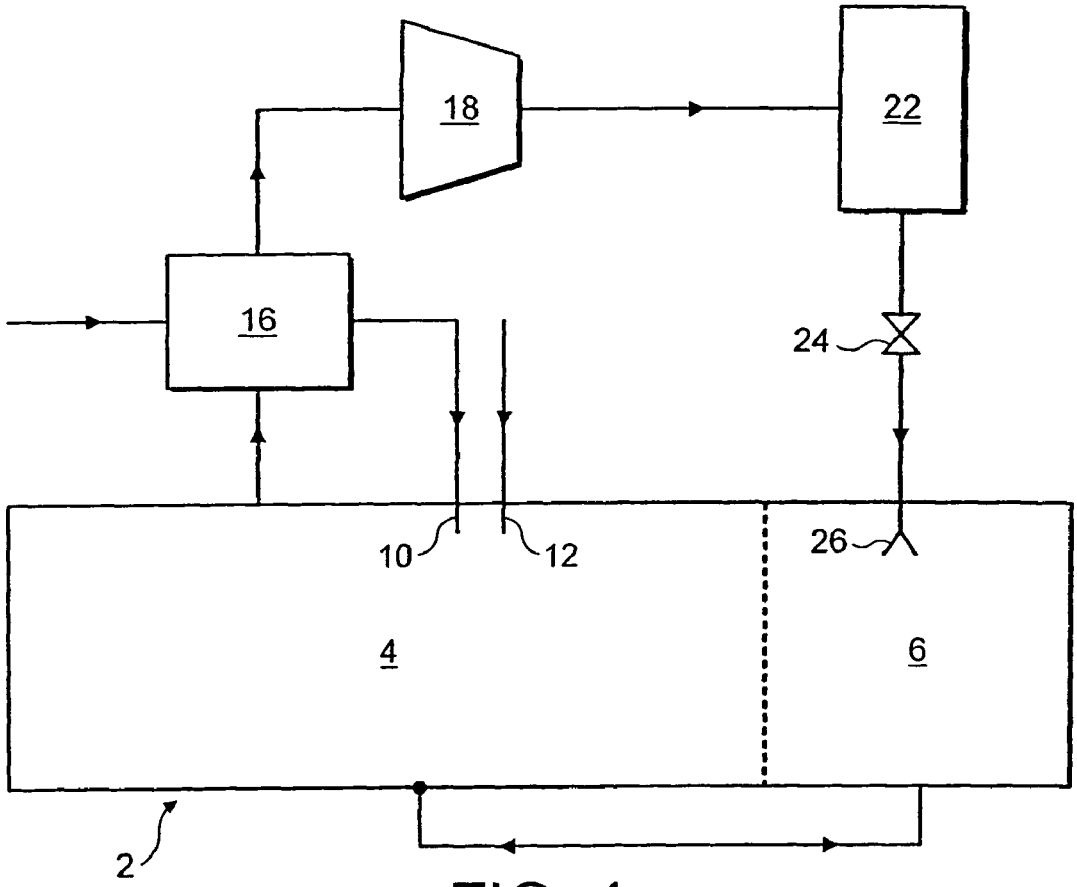

Referring to the drawing, a roller hearth furnace 2 has a carburising chamber 4 and a quenching chamber 6. The furnace also includes a belt (not shown) for transporting work to be carburised into the furnace 2, through the carburising chamber 4, then through the quenching chamber 6 and out of the furnace 2. The carburising chamber 4 has a first inlet 10 for nitrogen and a second inlet 12 for methanol. The positioning of the inlets may be conventional. The furnace is provided with an internal heater (not shown) so as to raise the temperature of the atmosphere in the carburising chamber 4 to a temperature in the range 850 to 950° C. Under these conditions, the methanol, if supplied in liquid form, will evaporate. Gaseous methanol cracks at the temperatures prevailing in the carburising chamber 4 to form hydrogen and carbon monoxide. Preferably, for each 55 moles of nitrogen, 45 moles of methanol are supplied to the carburising chamber 4. As a result, an atmosphere containing approximately 55% by volume of nitrogen, 30% by volume of hydrogen, and 15% by volume of carbon monoxide is formed, excluding minor impurities such as methane, water vapour and carbon dioxide. Typically, the water vapour content of this atmosphere is only to about 0.26%. A stream of the atmosphere is withdrawn from the carburising chamber 4 and passes through a heat exchanger 16 in which it is cooled to a temperature in the order of 50° C. by heat exchange with ambient temperature nitrogen upstream of the introduction of the nitrogen into the chamber 4 through the inlet 10. As a result, the nitrogen is preheated and this reduces the amount of thermal energy that needs to be supplied to the carburising chamber 4 by the internal heater (not shown).

The resulting cooled gas stream is compressed to a pressure of 7 bar g (8 bar absolute) in a compressor 18. The compressor 18 is preferably operated continuously and is sized such that the flow rate therethrough is less than that required for quenching. The compressor 18 is provided with an aftercooler (not shown) so as to remove heat of compression from the compressed gas. The compressed gas is supplied to a pressure vessel 22 in which it is stored. The pressure vessel 22 has a valved outlet 24 communicating with an array of nozzles 26 for directing gas at the object to be quenched in the quenching chamber 6. For ease of illustration, only one of the nozzles 26 is shown in the drawing. The distance from the nozzle outlet to the surface of the metal object against which the gas impinges is in the range of from a quarter to a half the nozzle diameter. Typically, the nozzle has a diameter in the range of 6.4 to 12.8 mm.

The actual flow rate of gas from the pressure vessel 22 to the nozzles 26 is greater than the rate at which gas flows into the pressure vessel 22. The normal operation of the furnace 2 is, however, such that the quenching chamber 6 is used only intermittently. Thus, the pressure vessel 22 can be so operated that it always contains a supply of quenching gas at pressure. While the quenching chamber 6 receives gas from the nozzles 26, the spent gas passes via a conduit 30 back into the carburising chamber 4. On the other hand during periods when the quenching chamber 6 is not being used, gas is able to pass from the carburising chamber 4 into it via the conduit 30 so as to maintain reducing conditions therein.

In view of the hydrogen content of the quenching gas, a quenching rate may be achieved in the chamber which can equal or exceed that achieved by conventional medium quench oils. Such a rapid quenching rate is achieved without the disadvantages attendant upon use of quenching oils, namely the need to clean the work after it has been quenched and the risk of some structural distortion being created by the quenching oil.

It will be understood that the embodiments described herein are merely exemplary and that a person skilled in the art may make many variations and modifications without departing from the spirit and scope of the invention. All such modifications and variations are intended to be included within the scope of the invention as defined in the appended claims.

What is claimed is:

1. A method of quenching a hot metal object, comprising:

taking a hot gas stream comprising at least 20% by volume of hydrogen from a source thereof; cooling the hot gas stream; compressing the cooled gas stream; removing heat of compression from the compressed gas stream; passing the compressed gas stream through at least one nozzle and causing the gas issuing from the at least one nozzle to impinge upon the hot metal object to quench the metal object; wherein the source of the hot gas stream is a heat treatment chamber from which the hot metal object is taken for quenching or a gas generator which supplies hot gas to the heat treatment chamber.

2. The method as claimed in claim 1, wherein the heat treatment is selected from the group consisting of annealing, hardening, carburising, case hardening, and carbonitriding.

3. The method as claimed in claim 1, wherein taking the hot gas stream from the heat treatment chamber or the gas generator is at a temperature in the range of 850° C. to 950° C.

4. The method as claimed in claim 2, wherein the heat treatment comprises carburizing the metal object and the hot gas comprises from 25% to 40% by volume of hydrogen.

5. The method as claimed in claim 4, wherein the hot gas further comprises from 40% to 60% by volume of nitrogen and from 12% to 20% by volume of carbon monoxide.

6. The method as claimed in claim 1, wherein the hot gas stream is compressed to a pressure up to 10 bar gauge and the compressed gas has a dew point less than 15° C.

7. The method as claimed in claim 1, wherein the heat treatment chamber is operated at a pressure in the range of 0 bar gauge to 1 bar gauge.

8. The method as claimed in claim 1, further comprising storing the compressed gas stream before the compressed gas stream is supplied to the at least one nozzle.

9. The method as claimed in claim 1, wherein a distance between an outlet of the at least one nozzle and a surface of the metal object at which the gas stream is directed is less than or equal to a diameter of the at least one nozzle.

10. The method as claimed in claim 1, wherein the gas stream issues from the at least one nozzle at a velocity of at least 50 meters per second.

11. The method as claimed in claim 1, wherein the hot gas contains from 25% to 40% by volume of hydrogen.

12. The method as claimed in claim 2, wherein the heat treatment is austenitic carbonitriding.

13. The method as claimed in claim 12, wherein the heat treatment comprises carburizing the metal object and the hot gas comprises from 25% to 40% by volume of hydrogen.

14. The method as claimed in claim 13, wherein the hot gas further comprises from 40% to 60% by volume of nitrogen and from 12% to 20% by volume of carbon monoxide.

* * * * *